US006962503B2

(12) United States Patent
Aekins

(10) Patent No.: US 6,962,503 B2
(45) Date of Patent: Nov. 8, 2005

(54) UNSHIELDED TWISTED PAIR (UTP) WIRE STABILIZER FOR COMMUNICATION PLUG

(75) Inventor: Robert A. Aekins, Branford, CT (US)

(73) Assignee: Ortronics, Inc., New London, CT (US)

( * ) Notice: Subject to any disclaimer, the term of this patent is extended or adjusted under 35 U.S.C. 154(b) by 0 days.

(21) Appl. No.: 09/968,616

(22) Filed: Oct. 1, 2001

(65) Prior Publication Data

US 2002/0151208 A1 Oct. 17, 2002

Related U.S. Application Data

(63) Continuation-in-part of application No. 09/479,484, filed on Jan. 10, 2000, now Pat. No. 6,319,048.
(60) Provisional application No. 60/237,759, filed on Sep. 29, 2000.

(51) Int. Cl.[7] ..... H01R 4/24
(52) U.S. Cl. ..... 439/418; 439/941
(58) Field of Search ..... 439/418, 941, 439/676, 696, 687, 457, 465, 470, 906

(56) References Cited

U.S. PATENT DOCUMENTS

| | | | | |
|---|---|---|---|---|
| 2,714,194 A | | 7/1955 | Beynink | |
| 4,108,527 A | * | 8/1978 | Douty et al. | 439/465 |
| 5,269,708 A | | 12/1993 | DeYoung et al. | |
| 5,299,956 A | | 4/1994 | Brownell et al. | |
| 5,310,363 A | | 5/1994 | Brownell et al. | |
| 5,326,284 A | | 7/1994 | Bohbot et al. | |
| 5,341,419 A | | 8/1994 | Ferry | |
| 5,362,257 A | | 11/1994 | Neal et al. | |
| 5,399,107 A | | 3/1995 | Gentry et al. | |
| 5,414,393 A | | 5/1995 | Rose et al. | |
| 5,432,484 A | | 7/1995 | Klas et al. | |
| 5,505,638 A | * | 4/1996 | Su et al. | 439/374 |
| 5,513,065 A | | 4/1996 | Caveney et al. | |
| 5,547,405 A | | 8/1996 | Pinney et al. | |
| 5,571,035 A | * | 11/1996 | Ferrill | 439/676 |
| 5,586,914 A | | 12/1996 | Foster, Jr., deceased et al. | |
| 5,599,209 A | | 2/1997 | Belopolsky | |
| 5,618,185 A | | 4/1997 | Aekins | |
| 5,639,266 A | | 6/1997 | Patel | |
| 5,647,770 A | | 7/1997 | Belopolsky | |
| 5,674,093 A | | 10/1997 | Vaden | |
| 5,687,478 A | | 11/1997 | Belopolsky | |
| 5,697,817 A | | 12/1997 | Bouchan et al. | |
| 5,759,070 A | | 6/1998 | Belopolsky | |
| 5,772,465 A | * | 6/1998 | Hwang et al. | 439/101 |
| 5,779,503 A | | 7/1998 | Tremblay et al. | |
| 5,830,005 A | * | 11/1998 | Watanabe | 439/418 |
| 5,864,089 A | | 1/1999 | Rainal | |
| 5,899,770 A | * | 5/1999 | Ezawa | 439/418 |
| 5,911,602 A | | 6/1999 | Vaden | |
| 5,913,702 A | | 6/1999 | Garcin | |
| 5,931,703 A | | 8/1999 | Aekins | |
| 5,938,479 A | | 8/1999 | Paulson et al. | |
| 5,967,801 A | * | 10/1999 | Martin et al. | 439/76.1 |
| 6,017,237 A | * | 1/2000 | Sullivan | 439/392 |
| 6,023,200 A | | 2/2000 | Rhee | |
| 6,080,007 A | * | 6/2000 | Dupuis et al. | 439/418 |
| 6,083,052 A | * | 7/2000 | Adams et al. | 439/418 |
| 6,089,923 A | | 7/2000 | Phommachanh | |
| 6,120,329 A | | 9/2000 | Steinman | |
| 6,155,881 A | | 12/2000 | Arnett et al. | |
| 6,231,397 B1 | * | 5/2001 | de la Borbolla et al. | 439/676 |

(Continued)

*Primary Examiner*—Gary Paumen
*Assistant Examiner*—Edwin A. Leon
(74) *Attorney, Agent, or Firm*—McCarter & English, LLP

(57) ABSTRACT

The present disclosure provides a stabilizer device for controlling de-embedded NEXT and FEXT variations that produced during patch cordage assembly by receiving a data transfer media cable having data elements therein, protecting against distortion of the elements which usually occurs during installation with a media plug and guiding the elements into the proper alignment to be easily connected with a media plug.

45 Claims, 6 Drawing Sheets

U.S. PATENT DOCUMENTS 6,250,949 B1 * 6/2001 Lin ..... 439/418
6,276,943 B1 * 8/2001 Boutros et al. ..... 439/676
6,319,048 B1 * 11/2001 Aekins et al. ..... 439/418
6,332,802 B2 * 12/2001 Hirokawa ..... 439/418
6,358,091 B1 3/2002 Lo et al.
6,358,092 B1 3/2002 Siemon et al.
6,371,793 B1 * 4/2002 Doorhy et al. ..... 439/404
6,375,491 B1 * 4/2002 Durand et al. ..... 439/418
6,379,175 B1 * 4/2002 Reede ..... 439/418

* cited by examiner

UNSHIELDED TWISTED PAIR (UTP) WIRE STABILIZER FOR COMMUNICATION PLUG

CROSS-REFERENCE TO RELATED APPLICATIONS

The subject application is a continuation-in-part of commonly owned, U.S. patent application Ser. No. 09/479,484, filed Jan. 10, 2000, of Aekins et al., now U.S. Pat. No. 6,319,048 issued Nov. 20, 2001, and also claims the benefit of commonly owned, U.S. Provisional Application Ser. No. 60/237,759, filed Sep. 29, 2000, the disclosures of which are herein incorporated by reference.

BACKGROUND OF THE DISCLOSURE

1. Technical Field

The present disclosure relates to devices for interfacing with high frequency data transfer media and, more particularly, to wire stabilizers, such as those that are used when installing a communication plug on an Unshielded Twisted Pair ("UTP") media, that advantageously compensate for and reduce electrical noise.

2. Background Art

In data transmission, the signal originally transmitted through the data transfer media is not necessarily the signal received. The received signal will consist of the original signal after being modified by various distortions and additional unwanted signals that affect the original signal between transmission and reception. These distortions and unwanted signals are commonly collectively referred to as "electrical noise," or simply "noise." Noise is a primary limiting factor in the performance of a communication system. Many problems may arise from the existence of noise in connection with data transmissions, such as data errors, system malfunctions and/or loss of the intended signals.

The transmission of data, by itself, generally causes unwanted noise. Such internally generated noise arises from electromagnetic energy that is induced by the electrical energy in the individual signal-carrying lines within the data transfer media and/or data transfer connecting devices, such electromagnetic energy radiating onto or toward adjacent lines in the same media or device. This cross coupling of electromagnetic energy (i.e., electromagnetic interference or EMI) from a "source" line to a "victim" line is generally referred to as "crosstalk."

Most data transfer media consist of multiple pairs of lines bundled together. Communication systems typically incorporate many such media and connectors for data transfer. Thus, there inherently exists an opportunity for significant crosstalk interference.

Crosstalk can be categorized in one of two forms. Near end crosstalk, commonly referred to as NEXT, arises from the effects of near field capacitive (electrostatic) and inductive (magnetic) coupling between source and victim electrical transmissions. NEXT increases the additive noise at the receiver and therefore degrades the signal to noise ratio (SNR). NEXT is generally the most significant form of crosstalk because the high-energy signal from an adjacent line can induce relatively significant crosstalk into the primary signal. The other form of crosstalk is far end crosstalk, or FEXT, which arises due to capacitive and inductive coupling between the source and victim electrical devices at the far end (or opposite end) of the transmission path. FEXT is typically less of an issue because the far end interfering signal is attenuated as it traverses the loop.

Unshielded Twisted Pair cable or UTP is a popular and widely used type of data transfer media. UTP is a very flexible, low cost media, and can be used for either voice or data communications. In fact, UTP is rapidly becoming the de facto standard for Local Area Networks ("LANs") and other in-building voice and data communications applications. The wide acceptance and use of UTP for data and voice transmission is primarily due to the large installed base, low cost and ease of new installation. Another important feature of UTP is that it can be used for varied applications, such as for Ethernet, Token Ring, FDDI, ATM, EIA-232, ISDN, analog telephone (POTS), and other types of communication. This flexibility allows the same type of cable/system components (such as data jacks, plugs, cross-patch panels, and patch cables) to be used for an entire building, unlike shielded twisted pair media ("STP").

There are typically four pairs of copper wires that are used, with each pair forming a twisted pair. The four pairs are used in horizontal cabling as well as for patch cabling or patch cordage. Patch cordage in terms of this disclosure is any unspecified length of UTP cable that is assembled by pressure crimping onto a RJ45 plug.

At present, UTP is being used for systems having increasingly higher data rates. Since demands on networks using UTP systems (e.g., 100 Mbit/s and 1200 Mbit/s transmission rates) have increased, it has become necessary to develop industry standards for higher system bandwidth performance. As the speeds have increased, so too has the noise. Systems and installations that began as simple analog telephone service and low speed network systems have now become high speed data systems. In particular, the data systems in the past used standard plug to cable assembly technique, which achieved reasonable Near-end Crosstalk (NEXT) and Far-end crosstalk (FEXT) noise levels and noise variability. The standard plug to cable assembly methods were used for the ANSI/TIA/EIA 568A "Commercial Building Telecommunications Cabling Standards" category 5 patch cords.

The ANSI/TIA/EIA 568A standard defines electrical performance for systems that utilize the 1 to 100 MHz frequency bandwidth range. Exemplary data systems that utilize the 1–100 MHz frequency bandwidth range include IEEE Token Ring, Ethernet10Base-T and 100Base-T. EIA/TIA-568 and the subsequent TSB-36 standards define five categories, as shown in the following Table, for quantifying the quality of the cable (for example, only Categories 3, 4, and 5 are considered "datagrade UTP").

TABLE

| Category | Characteristic specified up to (MHz) | Various Uses |
|---|---|---|
| 1 | None | Alarm systems and other non-critical applications |
| 2 | None | Voice, EIA-232, and other low speed data |
| 3 | 16 | 10BASE-T Ethernet, 4-Mbits/s Token Ring, 100BASE-T4, 100VG-AnyLAN, basic rate ISDN. Generally the minimum standard for new installations. |
| 4 | 20 | 16-Mbits/s Token Ring. Not widely used. |
| 5 | 100 | TP-PMD, SONet, OC-3 (ATM), 100BASE-TX. The most popular for new data installations. |

Underwriter's Laboratory defines a level-based system, which has minor differences relative to the EIA/TIA-568's category system. For example, UL requires the characteristics to be measured at various temperatures. However, generally (for example), UL Level V (Roman numerals are used) is the same as EIA's Category 5, and cables are usually marked with both EIA and UL rating designations.

Since the beginning of the ANSI/TIA/EIA 568A standard there has been no category 5 patch cord standard, but there has been a channel link standard. The channel link is a completely installed UTP cabling system that contains the patch cordage, connecting hardware and horizontal cables used for media connection of two or more network devices. The TIA/EIA is developing a patch cord standard as well as a plug level standard that will become requirements for development of category 5e (enhanced) and category 6 connecting hardwares.

Additionally, the EIA/TIA-568 standard specifies various electrical characteristics, including the maximum cross-talk (i.e., how much a signal in one pair interferes with the signal in another pair—through capacitive, inductive, and other types of coupling). Since this functional property is measured as how many decibels (dB) quieter the induced signal is than the original interfering signal, larger numbers reflect better performance.

Category 5 cabling systems generally provide adequate NEXT margins to allow for the high NEXT associated with use of present UTP system components. Demands for higher frequencies, more bandwidth and improved systems (e.g., Ethernet 1000Base-T) on UTP cabling, render existing systems and methods unacceptable. The TIA/EIA category 6 draft addendum related to new category 6 cabling standards illustrates heightened performance demands. For frequency bandwidths of 1 to 250 MHz, the draft addendum requires the minimum NEXT values at 100 MHz to be −39.9 dB and −33.1 dB at 250 MHz for a channel link, and −54 dB at 100 MHz and −46 dB at 250 MHz for connecting hardware. Increasing the bandwidth for new category 6 (i.e., from 1 to 100 MHz in category 5 to 1 to 250 MHz in category 6) increases the need to review opportunities for further reducing system noise.

By increasing the bandwidth from 1–100 MHz (cat 5) to 1–250 MHz (cat 6), tighter control of the components'noise variability is necessary. With the development of the new standards, the new plug noise variability will need to be better controlled than plugs that used old assembly methods.

Furthermore, the TIA/EIA Unshielded Twisted Pair Cabling task groups have developed a working draft for a UTP Connecting Hardware plug measurement parameter called NEXT de-embedding. The de-embedded NEXT procedure measures the pure NEXT and FEXT contributions of the plug and all other noise contributions are factored out of the final result. This method has become the de facto standard for RJ45 plug NEXT and FEXT characteristic measurement for plugs that are used to test connecting hardware performance. Plug de-embedded NEXT and FEXT variability was not an issue with category 5 connecting hardware or channel link systems, so upper and lower ranges were not specified. The TIA/EIA connecting hardware working groups have since realized that the plug de-embedded NEXT and FEXT must be controlled so the proper development of category 5e and category 6 connecting hardware/systems can become possible. The plug de-embedded NEXT and FEXT directly relates to the performance of the patch cordage and the connecting hardware that connects to it. Controlling the plug de-embedded NEXT and FEXT will enable control of the category 5, 5e and 6 NEXT performance. One method of category 5 connecting hardware crosstalk noise reduction and controlling is addressed in U.S. Pat. No. 5,618,185 to Aekins, the subject matter of which is hereby incorporated by reference.

The plug assembly crimping procedure heavily distorts the plug's de-embedded NEXT associated with patch cordage. This procedure is the final assembly method that forces the Insulation Displacement Contacts and the plug cable holding bar (also called strain relief) into their final resting positions. The plug cable holding bar is one of the main de-embedded NEXT disturbers since it distorts the wire pattern differently during the crimping stage.

In view of the increasing performance demands being placed on UTP systems, e.g., the implementation of category 6 standards, it would be beneficial to provide a device and/or methodology that is able to protect against wire distortion to reduce de-embedded NEXT and FEXT noises associated with patch cordage assembly.

SUMMARY OF THE DISCLOSURE

The present disclosure provides a stabilizer device for controlling de-embedded NEXT and FEXT variations that are produced during patch cordage assembly. Such stabilizer device advantageously reduces variations by receiving a data transfer media cable having data elements therein, protecting against distortion of the elements which usually occurs during installation with a media plug, and guiding the elements into proper alignment to be easily connected with a media plug.

In one aspect of the present disclosure, a stabilizer for protecting data transmitting elements in a connection between data transmission media having a plurality of pairs of data transmitting elements and a media plug having a female receiving port and a connecting end are disclosed.

In another aspect of the present disclosure, the stabilizer includes a support member body having a media receiving port, a plurality of guides for insulating and separating each pair of data transmitting elements, and a male media plug insertion end. The plurality of guides protect the pairs of elements from distortion and direct the pairs of elements into the connecting end of the media plug during installation with the media plug. Preferably, a means for crimping the pairs of elements is also included in the support member body.

In another aspect of the present disclosure, a data transmission plug assembly for protecting against distortion of data transmitting elements from data transmission media is disclosed. Generally, the data transmission media, such as UTP, has an outer sheath and a plurality of pairs of data transmitting elements within the outer sheath. The assembly includes a media plug having a connecting end and conduits for aligning the data elements to connect with other types of components. The media plug also has a female receiving port for receiving an advantageous stabilizer. The stabilizer has a media receiving port for engaging the data transmission media, a means for crimping the plurality of pairs of data transmitting elements, and a male insertion end for engaging the female receiving port of the media plug. The insertion end also generally includes a means for arranging the plurality of pairs of data transmitting elements to substantially conform with the alignment of data elements in the connecting end of the media plug. Preferably, the means for arranging the plurality of pairs to conform with the desired alignment is a plurality of insulative conduits for each pair of the plurality of pairs of data transmitting elements.

Other features and benefits of the disclosed stabilizer device and associated system/method will be apparent from the detailed description and accompanying figures which follow.

BRIEF DESCRIPTION OF THE DRAWINGS

So that those having ordinary skill in the art to which the subject disclosure appertains will more readily understand how to construct and employ the subject disclosure, reference may be had to the drawings wherein.

Figure 1A:
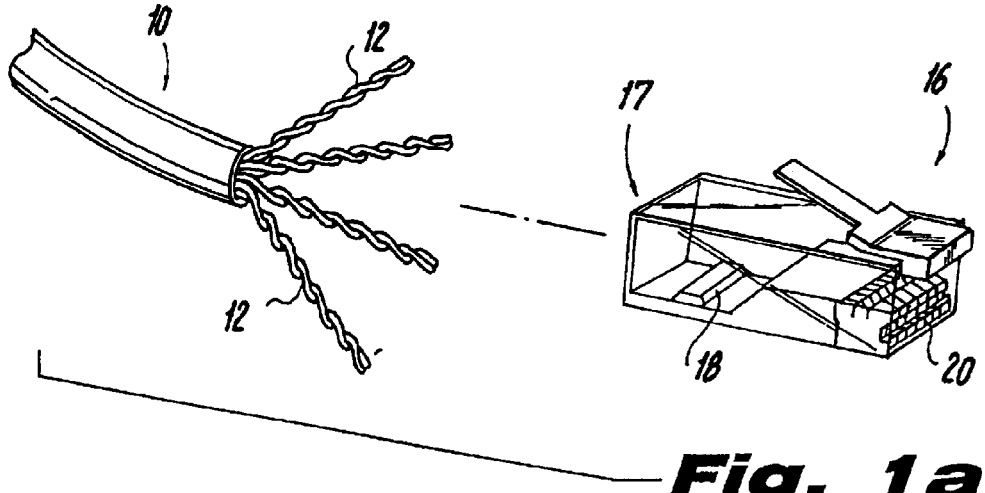
Fig. 1a (Prior Art)
FIGS. 1*a*, 1*b* and 1*c* provide a set of exploded perspective views illustrating the prior art assembly method of a RJ45 plug and UTP cable having four wire pairs.

These and other features of the exemplary stabilizer systems according to the subject disclosure will become more readily apparent to those having ordinary skill in the art from the following detailed description of preferred and exemplary embodiments.

DETAILED DESCRIPTION OF PREFERRED EMBODIMENT(S)

The following detailed description of preferred and/or exemplary embodiments of the present disclosure is intended to be read in the light of, or in context with, the preceding summary and background descriptions. Unless otherwise apparent, or stated, directional references, such as "up", "down", "left", "right", "front" and "rear", are intended be relative to the orientation of a particular embodiment of the disclosure as shown in the first numbered view of that embodiment. Also, a given reference numeral should be understood to indicate the same or a similar structure when it appears in different figures.

Figure 1B:
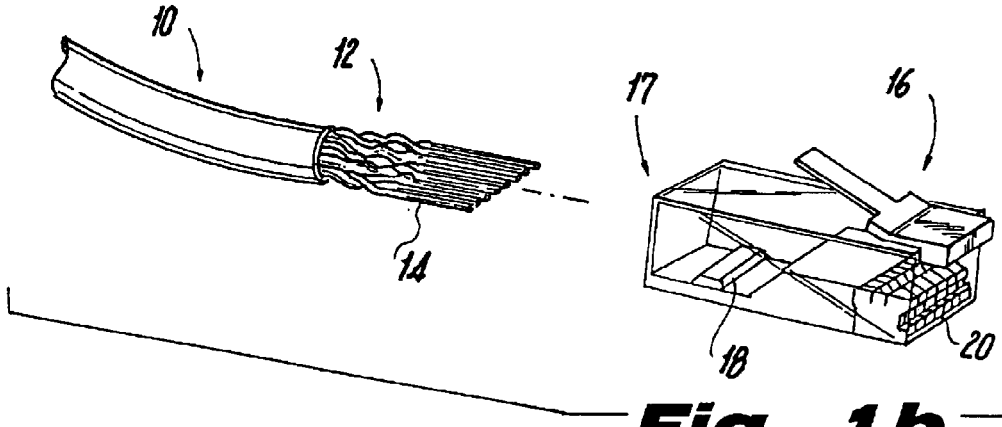
Fig. 1b (Prior Art)
Figure 1C:
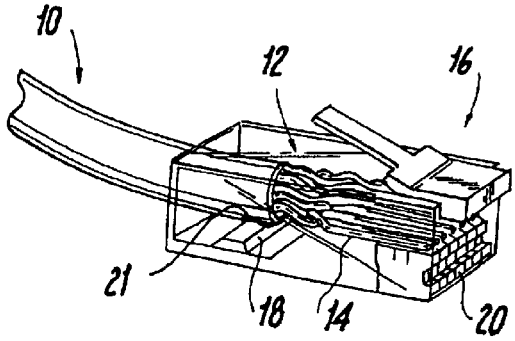
Fig. 1c (Prior Art)
Figure 2:
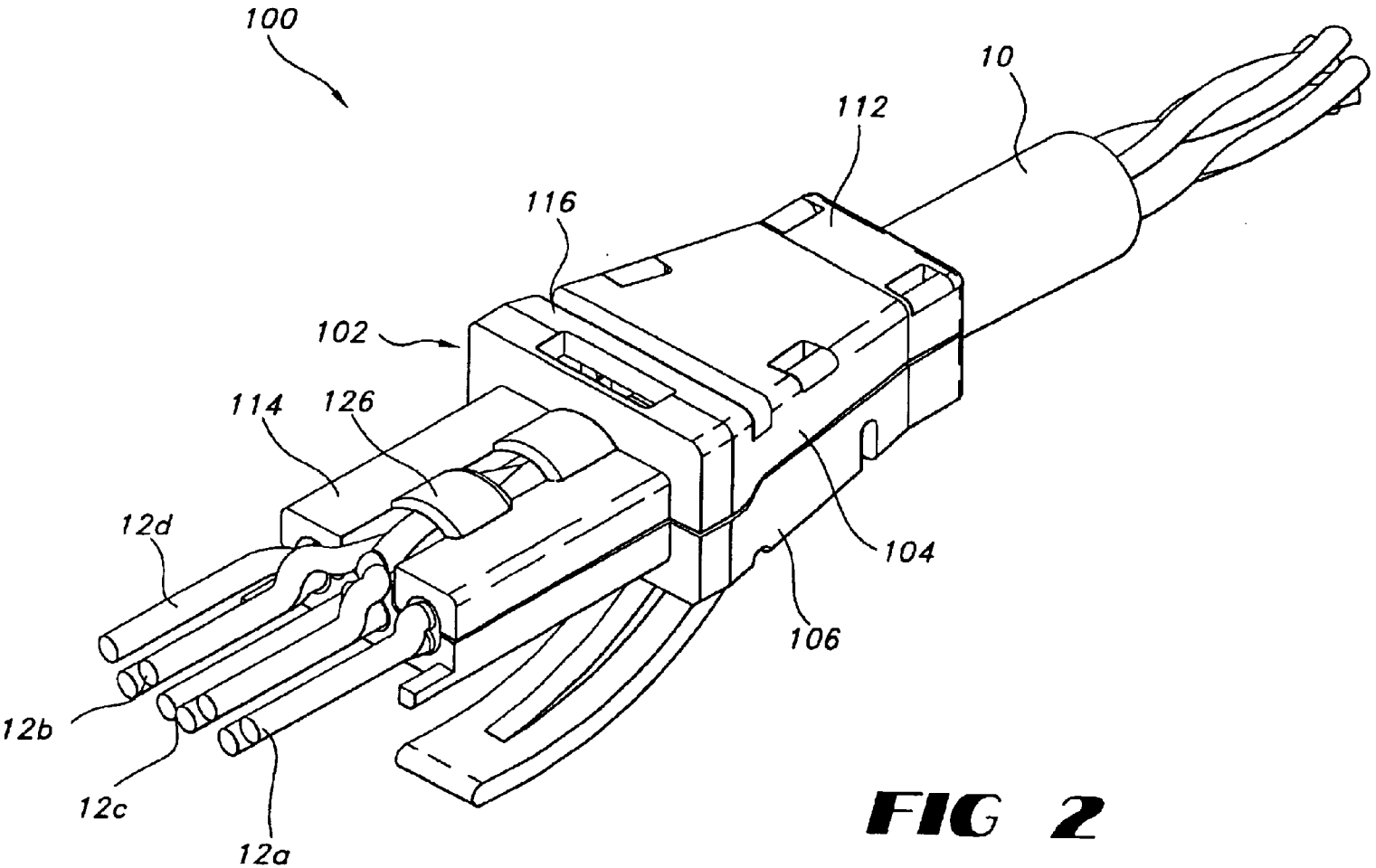
FIG. 2 is a perspective view of a wire stabilizer constructed in accordance with the present disclosure assembled together with a UTP cable.
Figure 3:
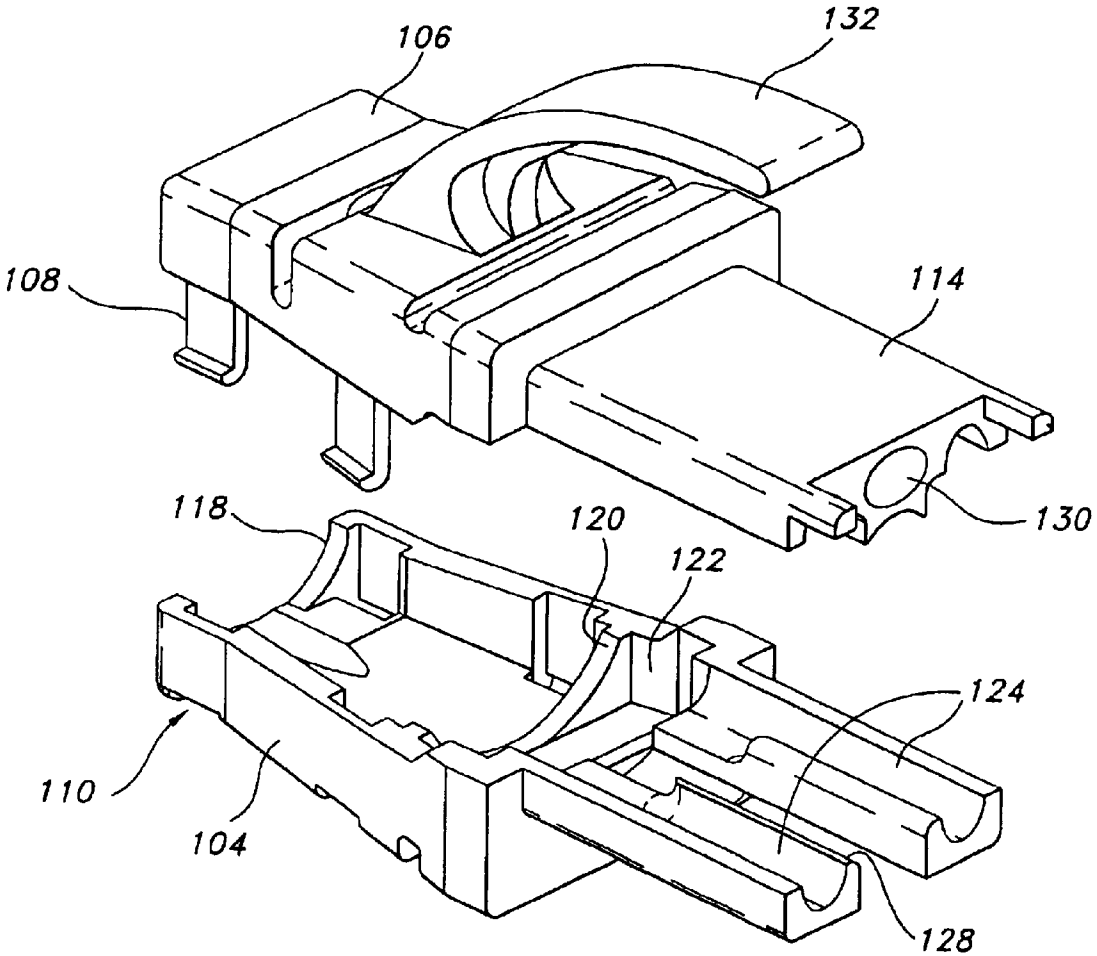
FIG. 3 is a perspective view of the first and second housing portions of the wire stabilizer depicted in FIG. 2.
Figure 5:
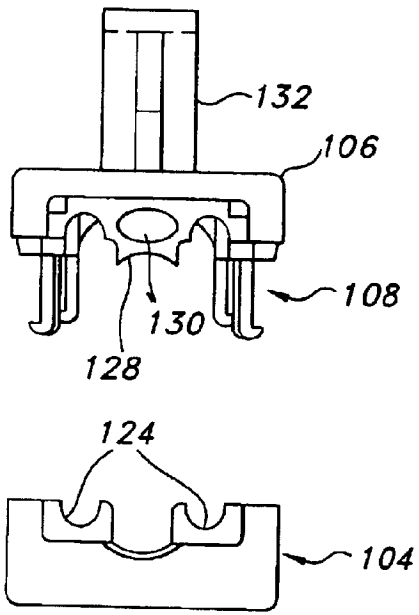
FIG. 5 is a front view of the plug insertion end of the wire stabilizer depicted in FIG. 2.
Figure 4:
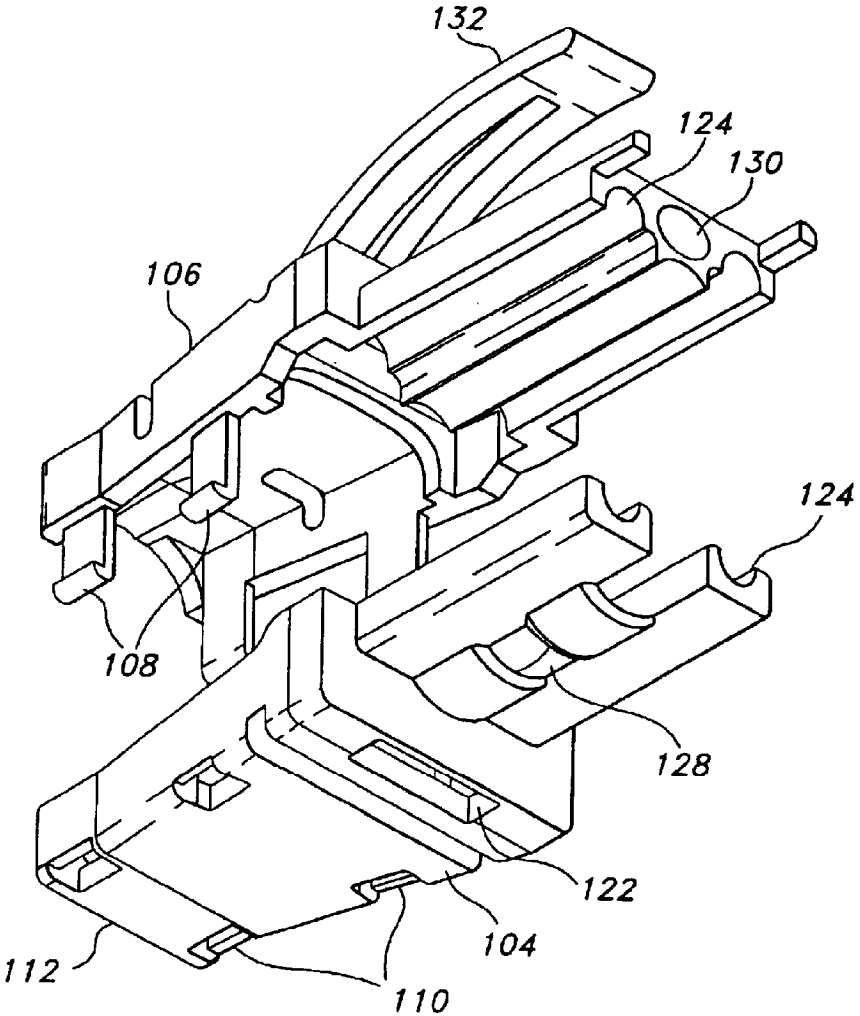
FIG. 4 is another perspective view of the first and second housing portions of the wire stabilizer depicted in FIG. 2.

FIGS. 1*a*, 1*b* and 1*c* illustrate the order of assembly in a typical prior art UTP cable to RJ45 plug installation. A UTP cable 10 containing four twisted wire pairs 12 is made up of individual wire conductors 14. A typical RJ45 plug 16 has a cable receiving cavity 17 into which cable 10 is inserted and a strain relief or crimp bar 18. RJ45 plug housing 16 also has eight Insulation Displacement Contacts ("IDC") contacts 20 that penetrate and expose the insulation of wires 14 and make contact with the conductive elements of other components into which plug 16 is inserted. After insertion of the cable 10, crimping pressure is applied to the exterior of the plug 16, and crimp bar 18 applies substantial pressure to cable 10 which causes the deformation of cable 10 at point 21, as seen in FIG. 1*c*. The crimping pressure applied to the housing also causes contacts 20 to penetrate the insulation of the wires 14.

FIGS. 2 through 5 illustrate a preferred embodiment of the presently disclosed stabilizer 100 installed on a UTP cable 10. Stabilizer 100 comprises a body 102 having first housing portion 104 and second housing portion 106 which are configured to securely mate with each other, thus encompassing cable 10. Preferably, body 102 has flat slotted sections for multiple icon label placements. Preferably, body 102 is fabricated of a synthetic resin, or any like material which is deformable, such as Acrylonitrile/Butadiene/Stryrene (ABS).

First and second housing portions 104 and 106 mate with each other via hooks 108 in the interior of housing 106 which fit into latches 110 in the interior of housing 104. Matable portions to surround cable 10 functions to aid in installation of stabilizer 100 and to facilitate mass production, among other things. The mating system may comprise a fastener device, or other conventional snap-fit mechanism, or re-attachable locking means.

When mated, first and second housing portions 104 and 106 form body 102, and generally define a cable receiving port 112, a plug insertion end 114 and an adapter section 116. Thus, receiving port 112, insertion end 114 and adapter section 116 each have a first and second portion defined on the first and second housing portions 104 and 106, respectively. Plug insertion end 114 is sized to fit within the cable receiving cavity 17 of plug 16.

Any reference made herein to cable receiving port 112, plug insertion end 114 and adapter section 116, or any other elements defined on cable receiving port 112, plug insertion end 114 and adapter section 116 which consist of first and second opposing portions defined on the first and second housings 104 and 106, is a reference to those elements as formed by the mated configuration of stabilizer 100 (i.e., when housing portions 104 and 106 are connected together), unless otherwise indicated.

Preferably, cable receiving port 112 has an aperture 118 which is of size and shape to substantially correspond to the size and shape of cable 10. In this exemplary embodiment, and typically in the field, the cable is round. Adapter section 116 provides a crimping bar 120 and chamber 122 for providing room for conductive wire pairs 12*a*, 12*b*, 12*c* and 12*d* which have been removed from cable 10, among other things. Wire pairs 12*a* and 12*d* are extended through chamber 122 and into two side wire guide channels 124 extending along the longitudinal axis of body 102, each located at opposing sides of plug insertion end 114. Wire pairs 12*b* and 12*c* are extended through a central wire guide 126 between side channels 124. Central wire guide 126 has a first central channel 128 and a second central channel 130 extending along the longitudinal axis of body 102 within insertion end 114 to accommodate the remaining two wire pairs 12*b* and 12*c* in cable 10. First channel 128 is located on first housing portion 104 and second channel 130 is located on second housing portion 106. The side channels 124 and first and second channels 128 and 130 are arranged in insert 114 so that the emerging wires are essentially in the same level plane which are then easily fit through plug 16 and into contacts 20.

Preferably, either first channel 128 or second channel 130 is fully insulated from the others, as shown by channel 130 in the embodiment depicted herein, to avoid increasing electromagnetic interference between any or all of the wire pairs. A hook member 132 which aids installation with plug 16, among other things, protrudes from the exterior of body 102 around the area of receiving port 112 in the direction of insertion end 114 from only second housing portion 106.

Figure 6:
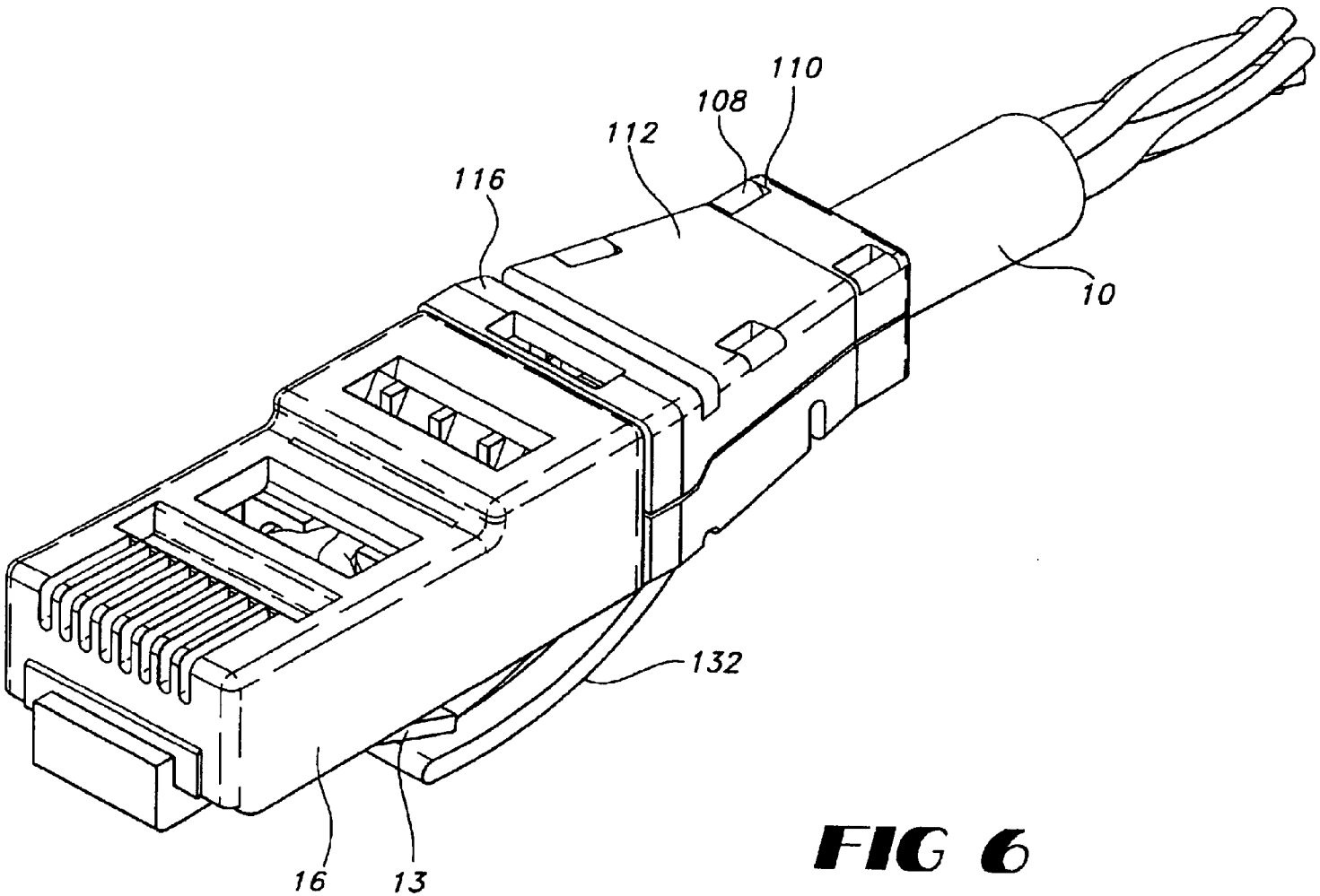
FIG. 6 is a perspective view of the wire stabilizer depicted in FIG. 2 assembled with a UTP cable and RJ45 plug.

To install a cable in stabilizer 100, outer insulation is stripped from cable 10 exposing the paired wires 12*a*, 12*b*, 12*c* and 12*d*, and cable 10 is placed through aperture 118 into port 112 prior to connecting first and second housing portions 104 and 106. Wire pairs 12*a*, 12*b*, 12*c* and 12*d* are extended into adapter section 116 over crimping bar 120 and through chamber 122. Wire pairs 12*a* and 12*d* are each placed individually in the two side wire guides 124. Either wire pair 12*c* or 12*d* may be inserted into either first or second channel 128 or 130. Once the placement of cable 10 and wire pairs 12*a*, 12*b*, 12*c* and 12*d* is complete throughout stabilizer 100, first and second housing portions 104 and 106 are mated together to secure the installation. Crimping bar 120 and the interior walls of chamber 122 crimp the wire pairs of cable 10 to secure cable 10 and the wire pairs in place. After the twisted wire pairs 12*a*, 12*b*, 12*c*, 12*d* exit stabilizer 100 into the intermediate section of the plug 16, they may be untwisted and straightened for seating within individual guide channels of the plug in which they are aligned correctly to connect with an IDC. When crimping pressure is applied to insert 114 while installing insert 114 in plug 16, wire pairs 12*a*, 12*b*, 12*c* and 12*d* are protected from distortions in their respective channels, that is, side channels 124 and first and second channels 128 and 130, respectively, and hook member 132 engages the plug latch 13, as shown in FIG. 6, to prevent reverse pull damages when removing a patch cord from tight locations, among other things.

Figure 7:
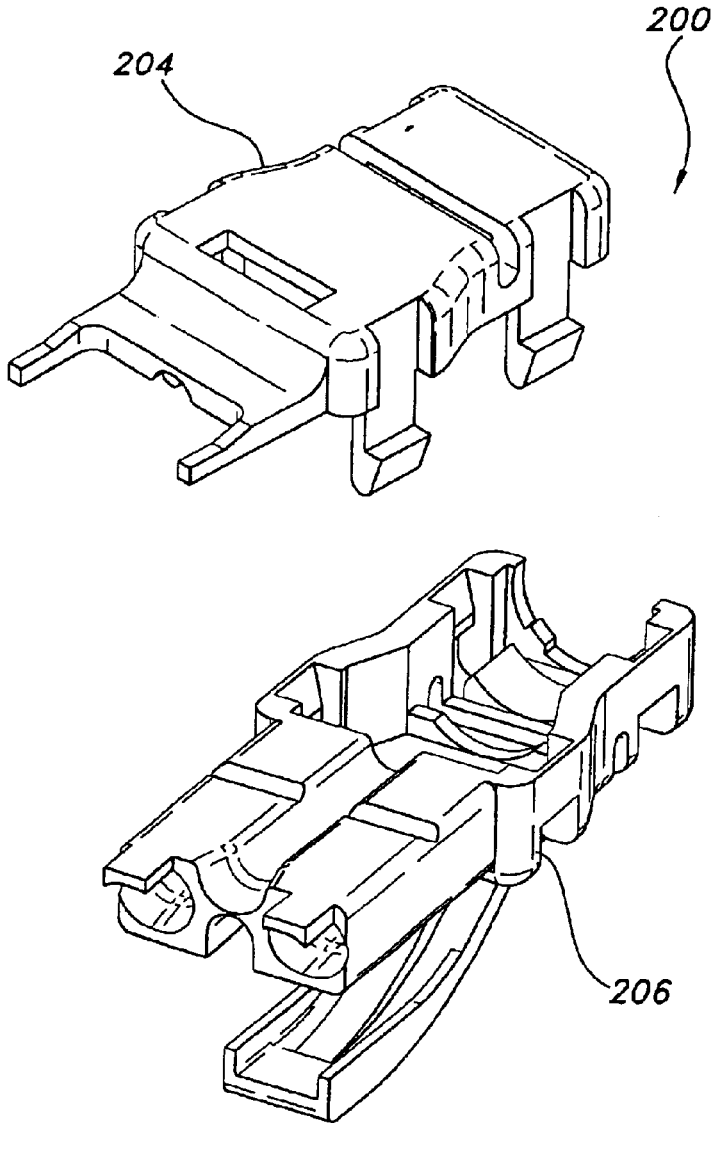
FIG. 7 is perspective view of the first and second housing portions of another embodiment of a wire stabilizer fabricated in accordance with the present disclosure.

FIG. 7 illustrates another embodiment of the present disclosure. Wire stabilizer 200 includes a first and second portion 204 and 206 having alternate guide channels substantially included in portion 206.

By stabilizing the wire pairs in stabilizer 100 prior to insertion into plug 16 and protecting against the crimping operation that follows, the wire pairs are not distorted or separated. As a result, the de-embedded NEXT and FEXT is controlled without any need for radical redesigning or over-molding of the standard plug. The specific configuration and dimensions may vary depending upon the recess in the plug into which it will be inserted so that it and can be utilized with existing plugs without requiring redesign and expensive retooling.

Thus, it can be seen from the foregoing detailed description and attached drawings that the novel plug and stabilizer of the present disclosure enables secure engagement of the wire pairs therein without distortion or excessive pressure upon the wire pairs to reduce and control crosstalk. The disclosed system facilitates the assembly of the wire pairs of the cable into the plug and transition from the round cross section of the cable into the desired perpendicular orientation of the lay of the wire pairs in a common plane and then the individual wires in the channels for engagement by the insulation displacement contacts. The novel assembly requires only the addition of stabilizer 100, which maintains cable pair perpendicularity in a low cost and easily mounted design.

Although the disclosed stabilizer and associated system have been described with respect to preferred embodiments, it is apparent that modifications and changes can be made thereto without departing from the spirit and scope of the invention as defined by the appended claims.

What is claimed is:

1. A stabilizer for use in association with a data transmission media having a plurality of pairs of data transmitting elements and a media plug having a female receiving port and a connecting end, the stabilizer comprising:

a support member body including a media receiving port and further including a male media plug insertion end for insertion into the female receiving port, the male media plug insertion end including a plurality of guides, the plurality of guides including a first guide, a second guide, a third guide, and a fourth guide for each receiving a respective pair of the plurality of pairs of data transmitting elements, said first guide and said second guide being disposed in a column, said third guide and said fourth guide being disposed in a row, said column being disposed between said third guide and said fourth guide and perpendicular to said row.

2. A stabilizer as recited in claim 1, further comprising a means for crimping the plurality of pairs of elements in the support member body.

3. A stabilizer as recited in claim 1, wherein the support member body is formed of two matable housing portions.

4. A stabilizer as recited in claim 1, wherein the support member body further comprises a means for being secured with the media plug.

5. A stabilizer as recited in claim 1, wherein the plurality of pairs of elements is four.

6. A stabilizer as recited in claim 1, wherein the plurality of guides are substantially parallel with respect to each other.

7. A stabilizer as recited in claim 1, wherein the plurality of guides are configured to arrange the plurality of pairs of elements in substantially the same plane.

8. A stabilizer as recited in claim 1, wherein the support member body is fabricated of a deformable synthetic resin.

9. A stabilizer as recited in claim 1, wherein the plurality of guides comprises conduits.

10. A plug assembly for use in association with a cable having a plurality of twisted pairs of insulated wires, the assembly comprising:

a) a stabilizer defining a receiving port and an insertion end, the receiving port receiving the plurality of twisted pairs of insulated wires, the stabilizer further defining a plurality of spaced apart channels;

b) a plug housing defining a receiving port and a connection end, the receiving port receiving the insertion end of the stabilizer and the plurality of spaced apart channels; and wherein the plurality of spaced apart channels includes a first channel, a second channel, a third channel, and a fourth channel each of which receives a respective pair of the pairs of insulated wires, said first channel and said second channel being disposed in a column, said third channel and said fourth channel being disposed in a row, said column being disposed between said third channel and said fourth channel and perpendicular to said row.

11. The plug assembly of claim 10 wherein said row is disposed at a first height relative to an exterior surface of the stabilizer and parallel to said exterior surface.

12. The plug assembly of claim 10 wherein the third channel and the fourth channel are disposed at opposing sides of the insertion end of the stabilizer.

13. The plug assembly of claim 10 wherein the first channel, the second channel, the third channel and the fourth channel extend parallel to a longitudinal axis of the stabilizer.

14. The plug assembly of claim 10 wherein the first channel, the second channel, the third channel, and the fourth channel each have an enclosed, longitudinally extending portion.

15. The plug assembly of claim 10 wherein one of the channels has a non-enclosed, longitudinally extending portion.

16. The plug assembly of claim 10 wherein the insertion end has a width and a height, the width being greater than the height.

17. The plug assembly of claim 10 wherein the first channel or the second channel is fully insulated from the third channel and the fourth channel.

18. The plug assembly of claim 10 wherein the receiving port of the stabilizer has an aperture which is of size and shape to substantially correspond to the size and shape of the cable.

19. The plug assembly of claim 10 wherein the plug housing further defines a plurality of guide channels each for receiving a respective one of the insulated wires.

20. The plug assembly of claim 10 wherein the stabilizer is formed of two matable housing portions.

21. The plug assembly of claim 20 one of the housing portions defines the third channel and the fourth channel.

22. The wire stabilizer of claim 21 wherein a first one of the housing portions define only a portion of one of the guide channels, and a second one of the housing portions defines another portion of said one guide channel and further defines the other guide channels of the four guide channels.

23. The plug assembly of claim 10 wherein the first channel is disposed at a first height relative to an exterior surface of the stabilizer, the second channel is disposed at a second height relative to said exterior surface, the second height being different than the first height, and the third channel is disposed at a third height relative to said exterior surface, the third height being different than the first height and the second height.

24. The plug assembly of claim 23 wherein the plug housing further includes a plurality of insulation displacement contacts each engageable with a respective one of said wires of the twisted pairs.

25. The plug assembly of claim 24 wherein the plug housing comprises a RJ45 plug housing.

26. The plug assembly of claim 24 wherein said row is disposed at a first height relative to an exterior surface of the stabilizer and parallel to said exterior surface, the third channel and the fourth channel are disposed at opposing sides of the insertion end of the stabilizer, the first channel, the second channel, the third channel and the fourth channel extend parallel to a longitudinal axis of the stabilizer, the first channel, the second channel, the third channel, and the fourth channel each have an enclosed, longitudinally extending portion, the receiving port of the stabilizer has an aperture which is of size and shape to substantially correspond to the size and shape of the cable, and the stabilizer is formed of two matable housing portions.

27. The plug assembly of claim 26 wherein the plug housing comprises a RJ45 plug housing.

28. A plug assembly for use in association with a cable having a plurality of twisted pairs of insulated wires, the assembly comprising:

a) a stabilizer defining a receiving port and an insertion end, the receiving port receiving the plurality of twisted pairs of insulated wires, the stabilizer further defining a plurality of spaced apart channels;

b) a plug housing defining a receiving port and a connection end, the receiving port receiving the insertion end of the stabilizer; and wherein the plurality of spaced apart channels includes a first channel, a second channel, and a third channel each of which receives a respective pair of the pairs of insulated wires, said first, second and third channels being disposed at three different heights relative to an exterior surface of the stabilizer.

29. The plug assembly of claim 28 wherein the plurality of spaced apart channels further comprises a fourth channel.

30. The plug assembly of claim 29 wherein the first channel and the second channel each being disposed between the third channel and the fourth channel, the first channel being disposed at a first height relative to an exterior surface of the stabilizer, the second channel being disposed at a second height relative to said exterior surface, the second height being different than the first height, the third channel being disposed at a third height relative to said exterior surface, the third height being different than the first height and the second height.

31. The plug assembly of claim 30 wherein the fourth channel is disposed at said third height relative to said exterior surface and parallel to said exterior surface.

32. The plug assembly of claim 30 wherein the third channel and the fourth channel are disposed at opposing sides of the insertion end of the stabilizer.

33. The plug assembly of claim 30 wherein the first channel, the second channel, the third channel and the fourth channel extend parallel to a longitudinal axis of the stabilizer.

34. The plug assembly of claim 30 wherein the first channel, the second channel, the third channel, and the fourth channel each have an enclosed, longitudinally extending portion.

35. The plug assembly of claim 30 wherein one of the channels has a non-enclosed, longitudinally extending portion.

36. The plug assembly of claim 30 wherein the insertion end has a width and a height, the width being greater than the height.

37. The plug assembly of claim 30 wherein the first channel or the second channel is fully insulated from the third channel and the fourth channel.

38. The plug assembly of claim 30 wherein the receiving port of the stabilizer has an aperture which is of size and shape to substantially correspond to the size and shape of the cable.

39. The plug assembly of claim 30 wherein the stabilizer is formed of two matable housing portions.

40. The plug assembly of claim 30 wherein the plug housing further defines a plurality of guide channels each for receiving a respective one of the insulated wires.

41. The plug assembly of claim 40 wherein the plug housing further includes a plurality of insulation displacement contacts each engageable with a respective one of said wires of the twisted pairs.

42. The plug assembly of claim 41 wherein the plug housing comprises a RJ45 plug housing.

43. The plug assembly of claim 42 wherein the third channel and the fourth channel are disposed at opposing sides of the insertion end of the stabilizer, the first channel, the second channel, the third channel and the fourth channel extend parallel to a longitudinal axis of the stabilizer, the first channel, the second channel, the third channel, and the fourth channel each have an enclosed, longitudinally extending portion, the receiving port of the stabilizer has an aperture which is of size and shape to substantially correspond to the size and shape of the cable, and the stabilizer is formed of two matable housing portions.

44. The plug assembly of claim 43 wherein the plug housing comprises a RJ45 plug housing.

45. A plug assembly for use in association with a cable having a plurality of twisted pairs of insulated wires, the assembly comprising:

a) a stabilizer defining a receiving port and an insertion end, the receiving port receiving the plurality of twisted pairs of insulated wires, the stabilizer further defining a plurality of spaced apart channels;

b) a plug housing defining a receiving port and a connection end, the receiving port receiving the insertion end of the stabilizer; and wherein the plurality of spaced apart channels includes a first channel, a second channel, a third channel, and a fourth channel each of which receives a respective twisted pair of the plurality of twisted pairs of insulated wires, said first channel and said second channel being disposed in a column, said third channel and said fourth channel being disposed in a row, said column being disposed between said third channel and said fourth channel and perpendicular to said row.

* * * * *